United States Patent [19]

Hire

[11] 4,413,247

[45] Nov. 1, 1983

[54] THERMALLY RESPONSIVE ELECTRICAL SWITCH MEANS AND METHOD OF MANUFACTURE

[75] Inventor: Charles J. Hire, Mansfield, Ohio

[73] Assignee: Hi-Stat Manufacturing Co., Inc., Lexington, Ohio

[21] Appl. No.: 348,589

[22] Filed: Feb. 12, 1982

[51] Int. Cl.[3] ..... H01H 37/28

[52] U.S. Cl. ..... 337/368; 337/380; 29/622

[58] Field of Search ..... 337/362, 365, 368, 373, 337/374, 380; 29/622

[56] References Cited

U.S. PATENT DOCUMENTS

Re. 26,554 3/1969 Bletz ..... 337/368 X 3,423,713 1/1969 Levinn ..... 337/368 X 3,581,263 5/1971 Moro ..... 337/368

*Primary Examiner*—George Harris

*Attorney, Agent, or Firm*—Lon H. Romanski

[57] ABSTRACT

A thermally responsive electrical switch assembly is shown having a housing with a dielectric end portion through which is formed a passage an axial portion of which has an integrally molded thread which coacts with an externally formed thread of an electrically conductive terminal member extending through the passage; a resiliently deflectable elastomeric member, generally within the housing, frictionally engages the terminal member as to thereby mask any otherwise perceived looseness between the externally formed and integrally molded threads and, instead, cause the terminal member to exhibit an apparent smooth movement during threadable adjustment thereof.

25 Claims, 5 Drawing Figures

THERMALLY RESPONSIVE ELECTRICAL SWITCH MEANS AND METHOD OF MANUFACTURE

FIELD OF THE INVENTION

This invention relates generally to the field of electrical switch means and more particularly to those electrical switch means which are thermally or temperature responsive.

BACKGROUND OF THE INVENTION

Generally, the prior art has proposed temperature responsive electrical switch means which consisted of a housing portion containing a bimetal member movable, in response to %sensed temperature, toward and away from a related fixed electrical contact or terminal as to thereby, in cooperation with such a fixed terminal, make and break an electrical circuit therethrough. In such prior art electrical switch assemblies, it was not an uncommon practice to have a cover or end wall member formed of dielectric material which, in turn, carried the fixed electrical contact. Often, such prior art fixed electrical contacts were threadably adjustable within the dielectric end cover as to thereby establish the desired calibration for the assembly.

Further, in such prior art switch assemblies, the threaded portion in the dielectric end cover were formed by machine tap which would cut the internal thread, within the dielectric end cover, which would cooperate with the external thread of the threadably adjustable fixed electrical contact or terminal.

A serious problem of such prior art switch assemblies resides in the fact that the dielectric material forming the end cover is, more often than not, relatively highly abrasive. Such abrasiveness, in turn, causes the taps to become quickly wornout resulting in internal thread conformations which will not accept, or at least properly accept, the external thread of the intended threadably adjustable fixed electrical contact or terminal. Consequently, there is a relatively high rate of scrapped dielectric end covers as well as a high usage rate of related thread taps. Such prior art structures, obviously, are relatively expensive to produce and because of the tap-wear, some of such prior art structures are, of necessity, close to the limits of acceptability. In some instances the prior art has suggested the use of nylon or glass-filled nylon material for forming the dielectric end cover; however, whatever benefits, if any, may have been found by the use of such material, in the fabrication of the switch assembly, the use of such materials is prohibited where the switch assembly and/or its environment may reach temperatures of about 250° F. or more.

Accordingly, the invention has herein disclosed and described is primrily directed to the solution of the aforestated and other attendant and related problems of the prior art.

SUMMARY OF THE INVENTION

Apparatus

According to the invention, an electrical switch assembly comprises a closure member of dielectric material which is molded as to have an integrally molded internal thread which threadably engages an external thread portion of an associated threadably adjustable electrical contact, and a frictional member frictionally engaging a portion of said electrical contact as to thereby present a generally constant frictional resistance to the movement of said electrical contact during threadable adjustment thereof.

Method

Further, according to the invention, a method of manufactuing a temperature responsive electrical switch assembly comprises the steps of forming a housing having a chamber with an open end, placing a thermally responsive member within said chamber, forming an end cover member as to have a passage therethrough with internal type thread portion integrally molded in said passage, securing taid cover member to said housing as to effectively close said open end, threadably engaging an axially adjustable electrical contact member with said integrally threaded portion, engaging said adjustable electrical contact member with a friction member whereby said friction member provides a frictional resistance to the threadable rotation of said adjustable contact member, and axially adjusting said electrical contact member by threadable rotation thereof as to have said adjustable contact member complete an electrical circuit at a selected temperature.

Other general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 2:
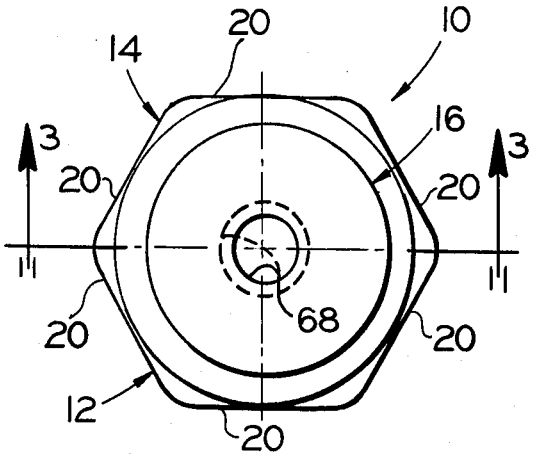
FIG. 2 is a view taken generally on the plane of line 2—2 of FIG. 1 and looking in the direction of the arrows with certain of the details omitted.
Figure 1:
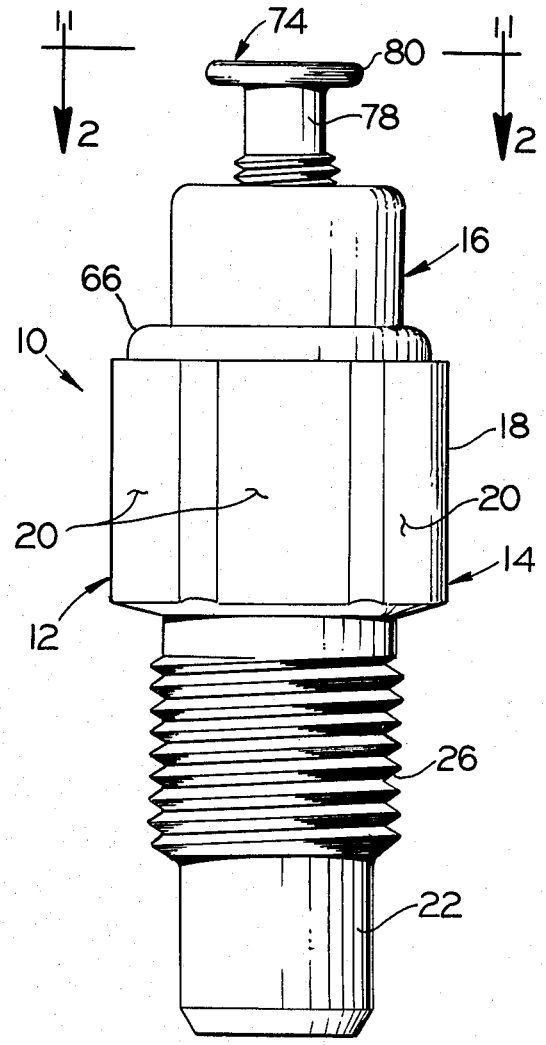
FIG. 1 is a side elevational view of a temperature responsive electrical switch assembly employing teachings of the invention.
Figure 3:
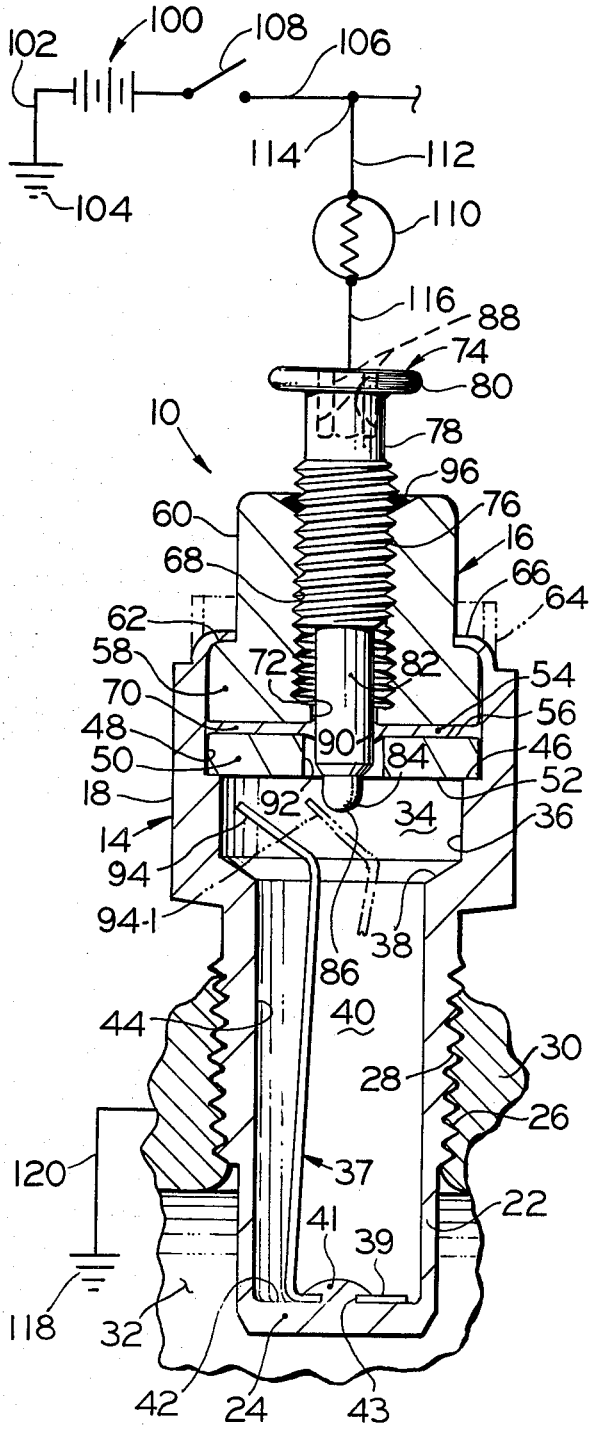
FIG. 3 is an axial cross-sectional view taken generally on the plane of line 3—3 of FIG. 2 and looking in the direction of the arrows, along with illustrative schematic electrical circuitry.

Referring now in greater detail to the drawings, FIGS. 1, 2 and 3 illustrate a temperature responsive electrical switch assembly 10 as comprising housing means 12 which, in turn, comprises generally lower (as viewed in FIGS. 1 and 3) disposed housing body means 14 and generally upper disposed housing body means or end cover means 16.

In the preferred embodiment housing or main body means 14 is formed to have a relatively enlarged upper end portion 18, provided with tool-engaging surfaces 20—20, and a lower generally tubular portion 22 which is closed as at its lower end by generally transverse wall means 24. In the preferred embodiment, the generally tubular extension 22 is provided with an integrally formed external threaded portion 26 which, as generally indicated in FIG. 3, is adapted to cooperatively engage an internally threaded portion 28 of a structure fragmentarily illustrated at 30. Portion 30 may, in fact, be a portion of, for example, an automotive engine or the like and when the switch assembly 10 is cooperatively secured therewith, as generally depicted, the lower projecting end of tubular body portion 22, shown as depending below the fragmentary structure 30, may, in fact, be placed in intimate contact with, for example, engine coolant flowing as through passage means 32 within structure 30.

The upper housing or body portion 18 is provided with a chamber-like portion 34, comprised as by a generally cylindrical surface 36 which, through a transitional portion 38 continues into a relatively elongated cylindrical chamber 40 comprised as of generally cylindrical inner wall surface 44 and end surface 42.

In the preferred embodiment, a temperature responsive electrically conductive member 37, such as, for example, a bimetal, is placed generally within chamber 40 as to have one end 39 fixedly secured as by means of an anchor portion 41 formed integrally with end wall 24, extending through an aperture 43 of end 39 and peened or otherwise formed-over as to fixedly secure leg or end 39 to end wall 24.

In the preferred embodiment, a circumferential flange or shoulder means 46 is formed internally in upper housing portion 18 and such shoulder means 46, preferably, extends as between cylindrical surface 36 and a second generally concentric upper disposed inner cylindrical surface 48.

A generally annular gasket support washer member 50 is closely received within cylindrical surface 48 as to have its under or inner-most end surface 52 in operative abutting engagement with flange or abutment surface means 46. Although the support member 50 is preferably formed of steel, such may be formed of any suitable material as, for example, a high strength plastic material.

A generally elastomerically flowable annular gasket or sealing means 54 is situated operatively against the upper surface 56 of support member 50. Although any suitable material may be employed for forming the gasket means 54, in the preferred embodiment the gasket means 54 is comprised of silicone rubber.

The upper housing or end cover means 16 is preferably formed as to be generally cylindrical and have a lower disposed relatively enlarged body portion 58 which, in conjunction with an upper body portion 60 of relatively reduced diameter define an outer annular flange-like or shoulder-like surface 62. The end cover member 16 is closely received within cylindrical surface 48 and held down against the gasket means 54 by virtue of an annular portion 64, depicted in phantom line, of housing means 14 being formed over and against shoulder 62 as depicted at 66.

In the preferred embodiment, the end cover member 16 is molded and during such molding process the internal threaded portion 68 is integrally molded. Although any suitable dielectric material may be employed, in the preferred embodiment the end cover or insulator member 16 is formed of a material preserving its integrity at relatively high temperatures such as, for example, "Plenco" or "Ryton". "Plenco" is a trade name for a two stage heat resistant phenolic which is mineral filled and made with resins of medium fast cure rate produced and sold by Plastics Engineering Company of 3518 Lake Shore Road, Sheboygan, Wis. "Ryton" is a trade name for a polyphenylene and sulfide resin produced and sold by Phillips Chemical Company of Bartlesville, Okla.

Even though not necessarily, it is preferred that the threaded portion 68 terminate short of the axial end surface 70 of member 16 and that for the remaining distance thereof a clearance type cylindrical passageway 72 be molded.

An electrically conductive terminal-contact member 74, provided with a generally axially intermediate externally threaded portion 76, has an upper cylindrical end portion 78 terminating as in a generally transverse head portion 80 and has a downwardly extending generally cylindrical shank or extension 82 at the end of which is formed a contacting portion 84 terminating in a preferably spherical configuration 86. The upper end of terminal means 74 is preferably provided with a recess-like or socket-like surface means 88 for the reception therein of suitable tool means for threadably rotating the terminal means 74 to attain axial adjustment thereof.

As the terminal means 74 is threadably engaged with the internal threaded portion 68 of the insulating means or end cover 16 and progressively threadably rotated, the shank portion 82 passes through an aperture 90 formed in gasket means 54 as well as a generally centrally situated clearance passageway 92 formed in gasket support means 50. The contact-terminal means 74 is thusly threadably axially adjusted until contact surface 86 is so positioned that when the temperature responsive means 37 senses a preselected temperature the temperature responsive means 37 will have deflected sufficiently as to result in end portion 94 thereof assuming a position of engagement with contact portion as generally fragmentarily depicted in phantom line at 94-1. Once the switch assembly has been thusly calibrated, the threadably adjustable terminal means 74 is preferably fixed or secured against further rotation. In the preferred embodiment this is achieved by applying a suitable cementing and sealing means as, for example, "Loctite" as generally indicated at 96 thereby both locking and sealing the terminal means 74 to the dielectric end cover 16 and preventing undesirable leakage as between coacting threaded portions 68 and 76. "Loctite" is a trademark of the Loctite Corporation of Newington, Conn., U.S., for an aerobic liquid polymers which automatically harden without the need of external heat or catalysts when confined between relatively closely fitted parts and may be applied to mating surfaces before during or after assembly thereof.

OPERATION OF THE INVENTION

If not now, it should become apparent that the invention may be employed in many different environments. By way of example, it is assumed that structure 30 comprises a portion of an engine and that the purpose of the switch means 10 is to close an electrical circuit through a selected electrical load means whenever it is sensed that the temperature of the engine coolant flowing through conduit or passage means 32 has attained a preselected temperature.

With such assumptions and referring in particular to FIG. 3, a source of electrical potential 100, is depicted as having one electrical side thereof electrically connected via conductor means 102 to ground potential as at 104. The other electrical side of source 100 is electrically connected to conductor means 106 which may lead to, for example, the ignition system of the associated engine and may also comprise a switch means 108 which may take the form of what is commonly referred to as the key operated ignition switch of an engine and/or vehicle and which is manually operated. A selected electrical load means 110 is shown as having one electrical end suitably electrically connected, as via conductor means 112, to conductor means 106 as at a point 114 while its other electrical end is suitably electrically connected via conductor means 116 to terminal means 74.

If it is now assumed that switch 108 is closed but that the temperature of the coolant flowing through conduit or passage 32 is less than a preselected temperature, the temperature responsive means 37 will not have moved sufficiently as to result in the end portion 94 moving to the position depicted at 94-1 whereat contact is made with contact surface or portion 86 of terminal means 74. During such a condition of operation the electrical load means 110 will remain de-energized.

However, with the switch 108 closed and when temperature responsive means 37 senses that the temperature of the coolant within conduit 32 has attained a preselected magnitude of temperature, means 37 will have then moved sufficiently as to cause the end 94-1 thereof to operatively engage or contact terminal contacting means 86 thereby closing the electrical circuit therethrough. At this time an electrical circuit is completed as from source 100, conductor means 106, point 114, conductor means 112, electrical load 110, conductor means 116, terminal means 74, contact portion 88, temperature responsive means 37 end portion 94-1, end or leg 39, end wall 24, tubular portion 22, structure 30 and back to ground 118 as via conductive means 120.

Figure 4:
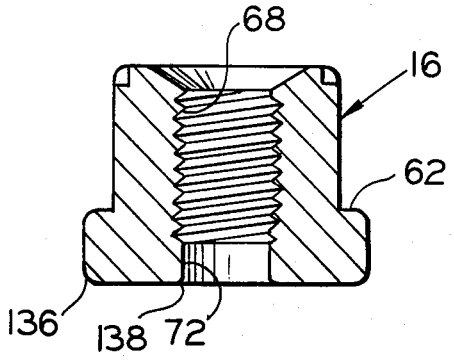
FIG. 4 is an axial cross-sectional view of one of the elements shown in each of FIGS. 1, 2 and 3.
Figure 5:
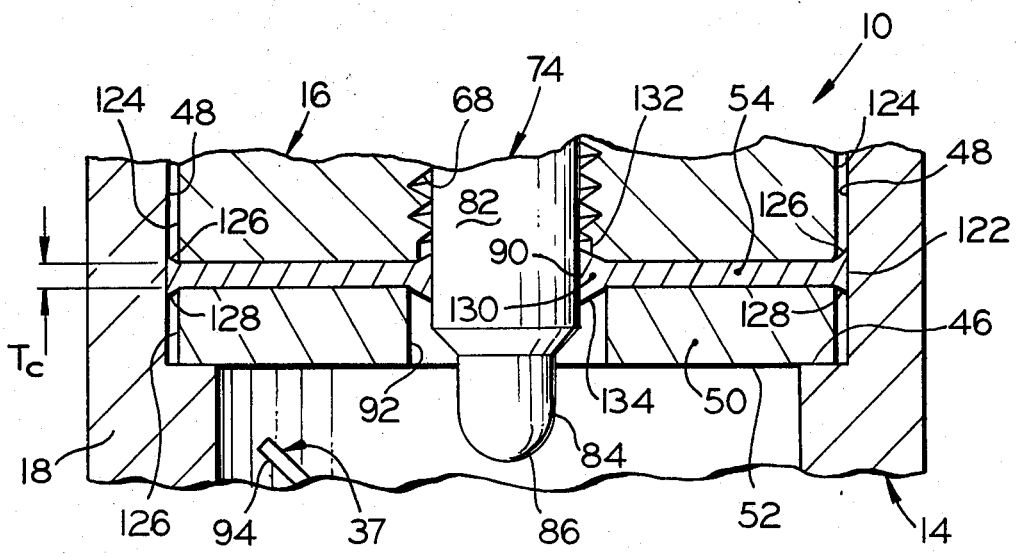
FIG. 5 is an enlarged view of a fragmentary portion of the structure shown in FIG. 3.

Referring also to FIGS. 4 and 5, and remembering that in the prior art one of the major problems was the forming of threads by using a thread tap, the threaded portion 68 of the end cover portion 16 are integrally formed during the molding of the end member 16. The configuration and sizing of the threaded portion 68, although functionally engagable with the outer threaded portion 76 of terminal-contact means 74, nevertheless, is relatively loose with respect to the coacting threaded portion 76. The looseness would become especially evident if such terminal-contact means 74 were threadably engaged with a coacting internal threaded portion which was machined as by a tapping operation. The apparent looseness of threaded engagement as between coacting threaded portions 68 and 76, as will become apparent, presents no adverse problems to the selective adjustment and set stability of the terminal-contact means 74.

Referring to FIGS. 3 and 5, and in particular to FIG. 5, the gasket means 54 is shown in its condition when the switch assembly 10 is fully assembled. That is, its cross-sectional thickness, as between end member 16 and support 50, is compressed whereby its cross-sectional compressed thickness may be represented by the dimension, $T_c$. As was previously stated, the gasket means 54 is of a dielectric elastomeric material which, because of its elastomeric qualities, can be made to elastomerically flow in controlled directions by the application thereto of selectively directed forces. Let it be assumed that in its free state the cross-sectional thickness of the gasket means 54 is of a magnitude, $T_f$, which is slightly greater than $T_c$. Further, in the preferred embodiment the generally central aperture 90 of gasket means 54, when in its free state, is of a size and configuration which at least closely approaches the size and cross-sectional configuration of the cylindrical extension portion 82 of terminal-contact means 74. Still further, in the preferred embodiment the outer cylindrical surface 122 of gasket means 54, when in its free state, is of a size and configuration which at least closely approaches the size and configuration of the inner cylindrical surface 48 of housing portion 18.

Primarily for sake of clarity, the annular gap or space as between the outer cylindrical surface 124 of end member 16 and the inner cylindrical surface 48 of housing portion 18, as well as the annular gap or space as between the outer cylindrical surface 126 of support means 50 and the inner cylindrical surface 48 of housing portion 18 are illustrated in somewhat exaggerated proportion to better show how the gasket means undergoes elastomeric flow during assembly of the switch means 10.

During assembly of the switch assembly 10, and in particular during the time that end closure means 16 is being secured as by the forming-over of portion 66 against shoulder 62, the elastomeric gasket means 54 is compressed, between closure means 16 and support means 50, causing its transverse thickness of, $T_f$, of its free state to be changed to the generally depicted lesser transverse thickness of $T_c$. Because of the elastomeric flowability of gasket means 54, such transverse compression of the main portion thereof results in both a generally radially inward and radially outward elastomeric extrusion of a portion of the material comprising the gasket means 54.

As generally depicted in FIG. 5, such radial outward extrusion results, first, in the outer cylindrical surface 122 thereof being tightly urged against surface 48 as to form a seal therebetween. Whatever additional volume of material, resulting from the said compression and which is not permitted to elastomerically flow radially outwardly because of the abutting of outer surface 122 against surface 48, is resiliently deflected both upwardly and downwardly to form generally annular bead-like or ridge-like portions 126 and 128, respectively. Since such bulbous annular portions 126 and 128 are under resilient deformation, their natural tendency is to return to the free state and such tendency, therefore, serves to continually exert a resilient elastomeric force continually urging outer surface 122 into sealing engagement with inner cylindrical surface 48.

Further, as also depicted in FIG. 5, such radial inward extrusion results, first, in the inner surface 90 thereof being urged against surface 82 of terminal-contact means 74. As generally illustrated, a relatively radially inner portion 130 extends somewhat beyond the upper supporting surface of support member 50 as to be situated generally within the area which would be included as by an upward extension of the passage means 92. Whatever additional volume of material, resulting from the said compression and which is not permitted to resiliently elastomerically flow radially inwardly because of the abutting of inner surface 90 against surface 82, is resiliently deflected both upwardly and downwardly to form generally annular bead-like, ridge-like or bulbous-like portions 132 and 134, respectively. Since such bulbous annular portions 132 and 134 are under resilient deformation, their natural tendency is to return to the free state and such tendency, therefore, serves to continually exert a resilient elastomeric force continually urging inner surface 90 radially inwardly into engagement with surface 82 of the terminal-contact means 74. Further, in the preferred embodiment, the various corners of both the support means 50 and end cover means 16 are radiused as typically illustrated in FIG. 4 at 136 and 138 thereby enhancing the ease of assembly of the various elements and eliminating any tendency to cut the gasket means 54 as during compression thereof.

As previously indicated the threadably adjustable terminal-contact means 74 is rather loosely engaged with the integrally molded threaded portion 68. Such apparent looseness, however, is effectively masked by the frictional resistance which occurs as between the radially inwardly resiliently urged surface and cylindrical surface 82 of terminal-contact means 74. That is, if manually threadably adjusted, the person so adjusting the terminal means 74 would feel a sensation which would mentally indicate that the threaded portions 76 and 68 were both of very accurate mating configurations and not that the coacting threaded portions were actually relatively quite loose and that, in fact, the threaded portion 68 was integrally molded with the remainder of the end cover means 16. This, of course, is brought about by the frictional resistance offered by the resiliently urged surface 90. That is, surface 90 offers frictional resistance to the axially downward (as viewed in FIG. 3 or 5) movement of terminal means 74 thereby causing the upper surface of the exterior thread 76 to be and remain in continuing contact with the lower surface of the interior molded thread 68 thereby eliminating any otherwise sensed looseness in the axial direction. Further, surface 90 also offers frictional resistance to the rotation of terminal means 74 and such frictional resistance also adds to the creation of a smooth rotational feeling of the terminal means 74.

Accordingly, it can be seen that the invention provides a means whereby the high cost of forming internal threaded portions within dielectric end covers or the like by the use of thread taps or the like can be completely eliminated by, instead integrally molding, in effect, a less accurate thread in the end cover member and then providing suitable friction means serving as a frictional brake to engage and frictionally restrict the movement of the terminal means threadably coacting with the said integrally molded threaded portion. Further, by employing, as the friction generating means, a resiliently elastomeric member (as 54) and squeezing such to cause elastomeric flow thereof, the same friction generating means can be employed for sealing purposes as at the area of contact as between surfaces 48 and 122. Further not only is means 54 capable of providing a sealing function as between surfaces 48 and 122, such friction generating means 54 also provides a sealing function against the surface 82 of terminal means 74 thereby preventing any of the sealing means 96 from flowing downwardly past means 54 which, if it were to occur, could result in deposits on the electrical contact surface 86 thereby effectively contaminating such contact surface 86.

Also, as should be apparent from the disclosure, although the temperature responsive means 37 has been depicted as the kind which would, upon attaining a sensed temperature, move to electrically close the circuit through terminal means 74, such temperature responsive means 37 may be of the type which would, upon sensing a preselected temperature, move to open the electrical circuit through terminal means 74 (in effect, moving end 94-1 to the solid line position of 94).

Although only a preferred embodiment and certain modifications of the invention have been disclosed and described, it is apparent that other embodiments and modifications of the invention are possible within the scope of the appended claims.

What is claimed is:

1. An electrical switch assembly, comprising switch housing means, said switch housing means comprising a housing portion molded of dielectric material, a passageway extending through said housing portion, at least a portion of the axial length of said passageway comprising an internal thread integrally molded as to be an integral part of said housing portion, an electrically conductive contact means, an external thread carried by said electrically conductive contact means, said electrically conductive contact means being received by said passageway as to have said external thread in cooperative engagement with said integrally molded internal thread, and friction generating means operatively engaging said electrically conductive contact means, said friction generating means being effective to exert a frictional force against said electrically conductive contact means as to resist without preventing the threadable adjustment of said electrically conductive contact means relative to integrally molded internal thread.

2. An electrical switch assembly according to claim 1 wherein said housing means comprises a second housing portion, wherein said second housing portion comprises an open end, and wherein the first mentioned housing portion molded of dielectric material is operatively secured to said second housing portion as to in effect close said open end.

3. An electrical switch assembly according to claim 1 wherein said housing means comprises a second housing portion, wherein said second housing portion comprises chamber means, and further comprising temperature responsive means generally contained within said chamber means and movable in response to sensed temperature, and wherein said temperature responsive means upon sensing a preselected magnitude of temperature is effective for closing an electrical circuit through said electrically conductive contact means.

4. An electrical switch assembly according to claim 3 wherein said second housing portion comprises an open end, and wherein the first mentioned housing portion molded of dielectric material is operatively secured to said second housing portion as to in effect close said open end.

5. An electrical switch assembly according to claim 1 wherein said friction generating means comprises resiliently deflectable elastomeric material.

6. An electrical switch assembly according to claim 2 wherein said friction generating means comprises resiliently deflectable elastomeric material, and wherein said friction generating means is contained generally between said first mentioned housing portion molded of dielectric material and said second housing portion.

7. An electrical switch assembly according to claim 3 wherein said friction generating means comprises resiliently deflectable elastomeric material.

8. An electrical switch assembly according to claim 3 wherein said friction generating means comprises resiliently deflectable elastomeric material, and wherein said friction generating means is contained generally between the first mentioned housing portion molded of dielectric material and said second housing portion.

9. An electrical switch assembly according to claim 1 wherein resiliently deflectable material comprises said friction generating means, wherein said friction generating means is of a generally annular configuration comprising a generally centrally situated passage and an outer circumferential surface, wherein said centrally situated passage operatively engages said electrically conductive contact means, and wherein said outer circumferential surface operatively sealingly engages said housing means.

10. An electrical switch assembly according to claim 9 wherein said housing means comprises a second housing portion having an open end, wherein the first mentioned housing portion molded of dielectric material is operatively secured to said second housing portion as to generally close said open end, and wherein said outer circumferential surface is in operative sealing engagement with said second housing portion.

11. An electrical switch assembly according to claim 1 and further comprising support means carried by said switch housing means generally internally thereof, said support means being effective to operatively engage and urge said friction generating means into said operative engagement with said electrically conductive contact means.

12. An electrical switch assembly according to claim 11 wherein said support means is of annular configuration having a generally centrally situated clearance passageway formed therethrough, and wherein said electrically conductive contact means at least in part extends through said clearance passageway.

13. An electrical switch assembly according to claim 9 and further comprising support means carried by said switch housing means generally internally thereof, said support means being of a generally annular configuration and having a generally centrally located clearance passageway formed therethrough, wherein said electrically conductive contact means at least in part extends through said clearance passageway, said support means being effective to operatively contain said friction generating means between itself and the first mentioned housing portion molded of dielectric material as to cause said centrally situated passage to operatively engage said electrically conductive contact means and as to cause said outer circumferential surface to operatively sealingly engage said housing means.

14. An electrical switch assembly according to claim 3 wherein said temperature responsive means comprises an electrically conductive member, and wherein said electrically conductive member comprises a portion of said electrical circuit.

15. An electrical switch assembly according to claim 3 wherein said temperature responsive means comprises an electrically conductive bimetal member, and wherein said electrically conductive bimetal member comprises a portion of said electrical circuit.

16. An electrical switch assembly according to claim 3 wherein said temperature responsive means comprises an electrically conductive bimetal member.

17. An electrical switch assembly according to claim 3 wherein said temperature responsive means comprises an electrically conductive member of which at least a portion is of a bimetal construction, wherein said electrically conductive member comprises first and second ends, wherein said first end is fixedly secured to said second housing portion, and wherein said second end is free to move in response to sensed temperature variations toward and away from said electrically conductive contact means.

18. An electrical switch assembly according to claim 1 wherein said housing means comprises a second housing portion, wherein said second housing portion comprises chamber means having an open end, and further comprising abutment surface means carried internally of and by said second housing portion, generally annular support means carried internally of said second housing portion so as to be operatively abutted against said abutment surface means, said annular support means comprising a generally centrally situated clearance passageway formed therethrough, temperature responsive means generally contained within said chamber means as to be disposed generally to one side of said annular support means, said temperature responsive means comprising an electrically conductive member of which at least a portion is of a bimetal construction, wherein said electrically conductive member comprises first and second ends, wherein said first end is fixedly secured to said second housing portion, wherein said second end is free to move in response to sensed temperature variations toward and away from said electrically conductive contact means, wherein resiliently deflectable material comprises said friction generating means, wherein said friction generating means is of a generally annular configuration comprising a generally centrally located passage and an outer circumferential surface, wherein said friction generating means is in operative abutting engagement with said generally annular support means at a second side of said annular support means opposite to said one side, wherein the first mentioned housing portion is held in operative abutting relationship to said friction generating means in a manner whereby some of the material comprising said friction generating means is resiliently transversely displaced at to cause said outer circumferential surface to at least tend to move radially outwardly and to cause the material defining said generally centrally located passage to at least tend to move radially inwardly as to at least tend to reduce the transverse area of said centrally located passage, wherein said outer circumferential surface operatively sealingly engages said second housing portion, wherein said frictional force is created by the material defining said centrally located passage operatively engaging said electrically conductive contact means, and wherein said electrically conductive contact means extends through said clearance passageway as to place a portion of said electrically conductive contact means in a position to be contacted by said second end of said electrically conductive member upon said electrically conductive member sensing a preselected magnitude of temperature.

19. A method of manufacturing an electrical switch assembly, comprising the steps of forming a housing having a chamber therein with an open end, forming a thermally responsive member, placing said thermally responsive member within said chamber, molding an end cover member as to have a passage therethrough with an internal type thread portion integrally molded in said passage, forming friction generating means, placing said friction generating means within said housing, securing said cover member to said housing as to generally close said open end and as to contain said friction generating means within said housing, forming an externally threaded electrical contact member, threadably engaging said externally threaded electrical contact member with said integrally molded thread portion, axially adjusting said electrical contact member by threadable rotation thereof as to cause said friction generating means to operatively engage said electrical contact member and provide a frictional resistance to the further threadable rotation of said electrical contact member, and axially adjusting said electrical contact member by threadable rotation thereof as to place said electrical contact member in a position whereby upon said thermally responsive member sensing a preselected magnitude of temperature on electrical circuit is completed through said electrical contact member.

20. A method of manufacturing an electrical switch assembly according to claim 19 and further comprising the steps of forming support means, and placing said support means within said chamber prior to placing said friction generating means within said housing.

21. A method of manufacturing an electrical switch assembly according to claim 19 wherein the step of forming said friction generating means comprises the step of employing resiliently deflectable elastomeric material in the forming thereof.

22. A method of manufacturing an electrical switch assembly according to claim 19 wherein the step of forming said friction generating means comprises the step of employing resiliently deflectable elastomeric material in the forming thereof, and wherein the step of securing said cover member to said housing comprises the step of causing said cover member to exert a compressive force against said friction generating means as to result in a general elastomeric displacement of some of said elastomeric material comprising said friction generating means in directions generally transverse to the direction of said compressive force.

23. A method of manufacturing an electrical switch assembly according to claim 22 wherein the step of molding said end cover comprises the step of employing a dielectric material for the molding thereof.

24. An electrical switch assembly according to claim 1 wherein said housing means comprises a second housing portion, wherein said second housing portion comprises chamber means, and further comprising temperature responsive means generally contained within said chamber means and movable in response to sensed temperature, and wherein said temperature responsive means upon sensing a preselected magnitude of temperature is effective for opening an electrical circuit through said electrically conductive contact means.

25. An electrical switch assembly according to claim 5 and further comprising sealing means applied to at least portions of said external thread and said integrally molded internal thread, and wherein said friction generating means comprised of resiliently deflectable elastomeric material while exerting a frictional force against said electrically conductive contact means serves to seal against the flow of any of said sealing means therepast as to thereby avoid contamination of said electrically conductive contact means.

* * * * *

UNITED STATES PATENT AND TRADEMARK OFFICE

CERTIFICATE OF CORRECTION

PATENT NO. : 4,413,247

DATED : November 1, 1983

INVENTOR(S) : Charles J. Hire

It is certified that error appears in the above—identified patent and that said Letters Patent is hereby corrected as shown below:

Column 1, line 16, delete "%".

Column 1, line 56, change "primrily" to --- primarily ---.

Column 2, line 13, change "taid" to --- said ---.

Claim 19, line 25 thereof, between "temperature" and "electrical" delete "on" and substitute therefor --- an ---.

Signed and Sealed this

*Third* Day of *January 1984*

[SEAL]

*Attest:*

GERALD J. MOSSINGHOFF

*Attesting Officer*

*Commissioner of Patents and Trademarks*